United States Patent [19]

Wilbur, Jr. et al.

[11] Patent Number: 4,467,242

[45] Date of Patent: Aug. 21, 1984

[54] COLOR SELECTION ELECTRODE MOUNTING STRUCTURE HAVING AN OFF-SET WASHER

[75] Inventors: Leonard P. Wilbur, Jr., Lancaster; Myron H. Wardell, Jr., Lititz, both of Pa.

[73] Assignee: RCA Corporation, New York, N.Y.

[21] Appl. No.: 434,936

[22] Filed: Oct. 18, 1982

[51] Int. Cl.[3] ..... H01J 29/07

[52] U.S. Cl. ..... 313/406; 313/407

[58] Field of Search ..... 313/406, 407, 404

[56] References Cited

U.S. PATENT DOCUMENTS

| | | | |
|---|---|---|---|
| 3,334,259 | 8/1967 | Shrader | 313/85 |
| 3,387,160 | 6/1968 | Schwartz | 313/85 |
| 3,803,436 | 4/1974 | Morrell | 313/85 |
| 4,002,941 | 1/1977 | Demmy | 313/402 |

FOREIGN PATENT DOCUMENTS

| | | | |
|---|---|---|---|
| 109344 | 8/1980 | Japan | 313/406 |

*Primary Examiner*—Palmer Demeo

*Attorney, Agent, or Firm*—Eugene M. Whitacre; Dennis H. Irlbeck; Vincent J. Coughlin, Jr.

[57] ABSTRACT

A cathode ray tube includes a faceplate panel with a plurality of electrode support studs distributed about and attached to the panel. A color selection electrode having a plurality of support springs is disposed within the panel. Each of the support springs comprises a strap-like element having a proximal end secured to the electrode and a distal end spaced from the electrode. A washer-like element is located between the panel and the distal end of at least one of the strap-like elements. The washer-like element has a frustoconically-shaped portion with an aperture therein for snugly receiving one of the studs. The base portion of the washer-like element is substantially flat and is permanently secured to the strap-like element near its distal end.

3 Claims, 7 Drawing Figures

COLOR SELECTION ELECTRODE MOUNTING STRUCTURE HAVING AN OFF-SET WASHER

BACKGROUND OF THE INVENTION

The invention relates to cathode ray tubes and particularly to cathode ray tubes having a color selection electrode with a plurality of support springs disposed over a plurality of support studs which are affixed to a faceplate panel. At least one of the springs includes an improved securing means for detachably attaching the color selection electrode to the support stud.

In U.S. Pat. No. 3,334,259 issued to T. M. Shrader on Aug. 1, 1967, a shadow mask mounting structure is described. In the preferred embodiment of the Shrader structure, each of the strap-like support springs attached to the shadow mask includes a flat washer having a stud receiving aperture with three projecting fingers which are suitably shaped and inwardly directed to mate with a frustoconical support stud tip. With the mask assembly in position within the faceplate panel and spaced therefrom using a Q-set or panel-to-mask assembly spacer device, the support springs are depressed toward the mask frame and the washers are inserted over the support studs between the straps and the studs, with the stud tips snugly received within the washer apertures. In such an arrangement, the spring action of the support springs urges the washers against the frustoconical tips of the studs to keep the washers in place.

At this point in the fabrication procedure, the washers are still free to move relative to the support springs, and the mask assembly and the Q-set spacer device are still free to be urged together and against the interior surface of the faceplate. Thus, in this condition, a precisely desired Q-spacing between the mask member and the faceplate and a precise alignment of the stud receiving apertures of the washers with the studs can be established.

The washers are then attached to the support springs, such as by temporary tack welding. Then, with the completely assembled mask electrode removed from the panel, a more secure weld using larger equipment is provided. The reason for making the initial tack weld is that the larger welding equipment cannot easily be fitted into the space between the frame and the faceplate panel sidewall when the mask assembly is disposed within the panel.

Experience has shown that since the welding electrodes used to tack weld the washers to the support springs must be relatively thin to fit between the frame and the panel sidewall, the welding electrodes are fragile and require frequent maintenance and replacement. Additionally, the tack welds tend to be relatively weak and often break when the mask assembly is removed from the panel. Thus, a considerable amount of reworking is required at additional cost to attach the washers to the support springs.

It is thus desirable to provide a color selection electrode mounting structure in which a securing washer can be permanently affixed to the support spring while the color selection electrode mounting structure is disposed within the faceplate panel, thereby eliminating the tack welding step of the fabrication procedure.

SUMMARY OF THE INVENTION

A cathode ray tube includes a faceplate panel, a plurality of electrode support studs distributed about and attached to the panel, and a color selection electrode including a plurality of support springs. Each of the support springs comprises a strap-like element having a proximal end secured to the electrode and a distal end spaced from the electrode. A washer-like element is located between the panel and the distal end of at least one of the strap-like elements. The washer-like element has a frustoconically-shaped stud-engaging portion with an aperture therein and a substantially flat base portion. The base portion is permanently secured to the strap-like element near its distal end.

DETAILED DESCRIPTION OF THE PREFERRED EMBODIMENTS

Figure 1:
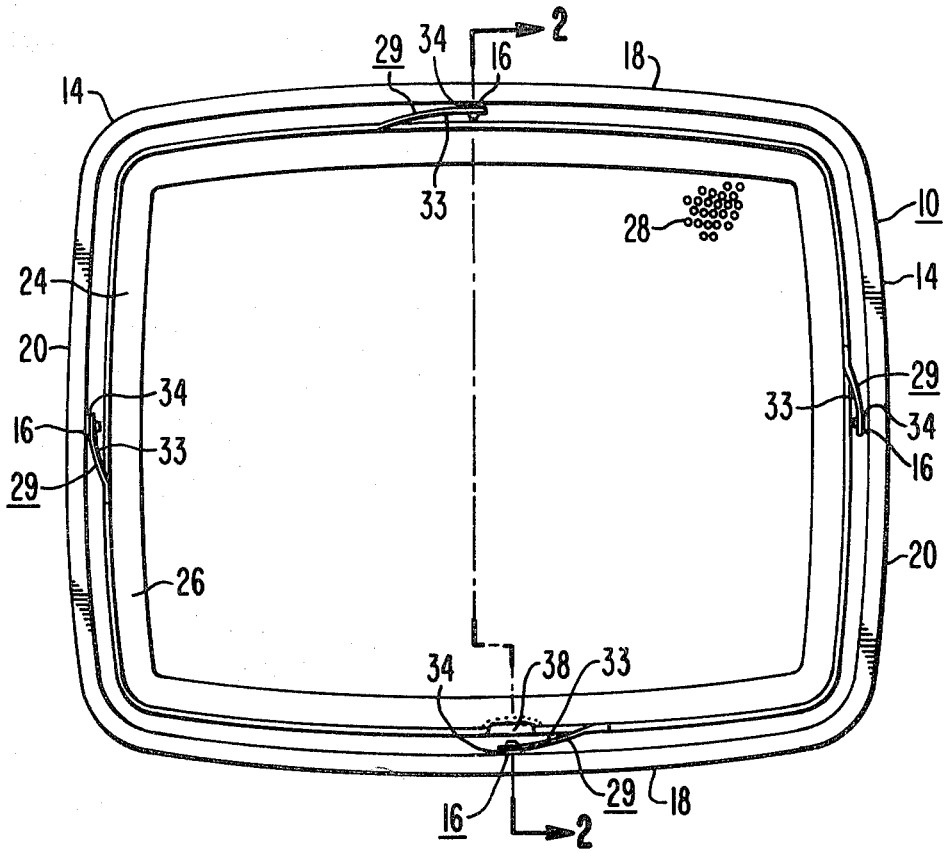
FIG. 1 is a plan view of a cathode ray tube faceplate panel and color selection electrode according to the present invention.
Figure 2:
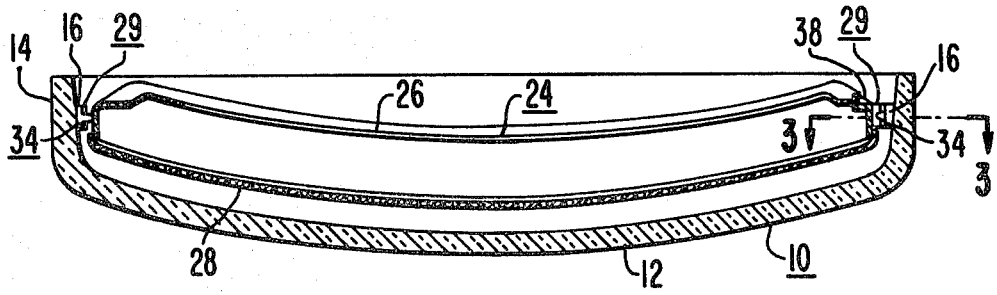
FIG. 2 is a sectional view taken along line 2—2 of FIG. 1.

With reference to FIGS. 1 and 2, a cathode ray tube glass faceplate panel 10 comprises a generally rectangular faceplate 12 and a sidewall 14 extending from the periphery of the faceplate. A plurality of electrode mounting studs 16 extend from the interior surface of the panel sidewall 14. The studs 16 may be bonded to the surface of the sidewall with, e.g., a glass frit, or they may be embedded in the sidewall by a conventional glass-to-metal seal. In a preferred arrangement, four studs are provided, one near the midpoint of the upper long side 18 of the sidewall 14, one displaced about 8.53 mm from the midpoint of the lower long side 18 of the sidewall 14, and one near the midpoint of each of the two short sides 20 of the sidewall 14. The studs 16 are preferably located at a predetermined height above the faceplate 12. Each stud 16 (FIGS. 3, 4 and 5) comprises a cylindrical base 21 and a frustoconical tip 22.

A color selection electrode such as a shadow mask electrode 24, mounted within the faceplate panel 10, includes a frame member 26 and a masking member 28. The frame 26 comprises a generally rectangular loop-shaped rim having an L-shaped cross section. The masking member 28 comprises a multiapertured sheet of metal mounted across the frame 26. The masking member 28 has a surface contour which approximately matches the surface contour of the faceplate 12.

Figure 3:
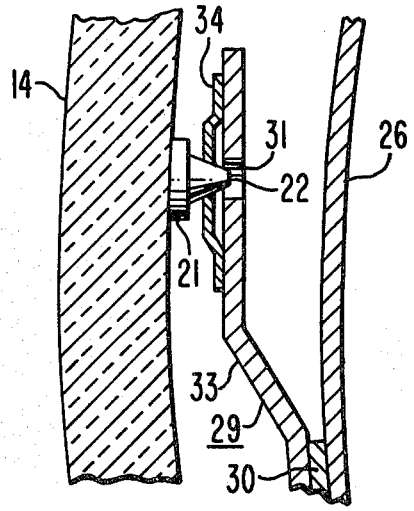
FIG. 3 is an enlarged sectional view of a portion of the device of FIGS. 1 and 2 taken along line 3—3 of FIG. 2.

A plurality of support springs 29 are attached to the mask electrode 24 and support it on the studs 16. As shown in FIG. 3, each of the support springs 29 comprises a strap-like element 33 which has its proximal end attached to a temperature compensating bimetallic clip 30. The clip 30 is secured to the side of the frame 26 such as by spot welds. The distal end of each strap-like element 33 is off-set outwardly from the side of the frame and provided with a stud-receiving aperture 31. The stud receiving aperture 31 is configured to detachably engage the frustoconical tips 22 of the studs 16 to removably mount the mask electrode 24 within the panel 10 at a distance, or assumed Q-spacing, above the faceplate 12 which is controlled by the height at which the studs 16 are attached to the sidewall 14. The mask electrode 24 may be removed and/or remounted by depressing the support springs 29 toward the frame 26 and free of the studs 16. The stud 16, which is displaced from the midpoint of the lower long side 18 of the sidewall 14 by about 8.53 mm, assures that the mask electrode 24 cannot be remounted upside down since the nonsymmetrical location of one of the studs 16 allows only one correct mask mounting orientation. The spring 29, which contacts the studs 16 on the lower long side 18 of the sidewall 14, includes, in addition to the strap-like element 33, a novel washer-like element 34.

Figure 6:
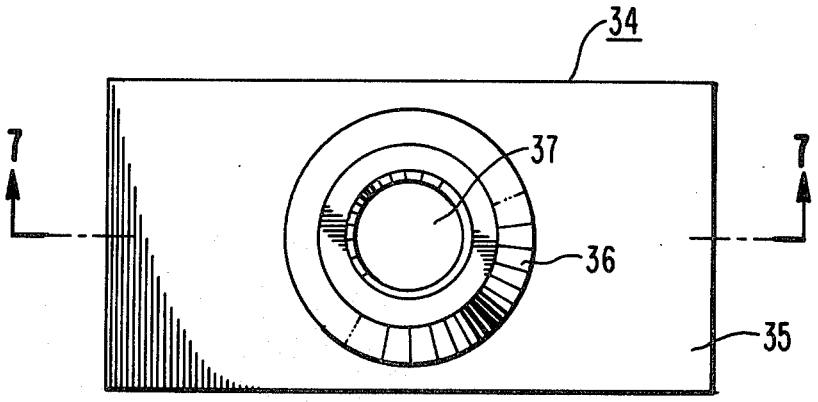
FIG. 6 is an enlarged plan view of the novel off-set washer of FIG. 3.
Figure 7:
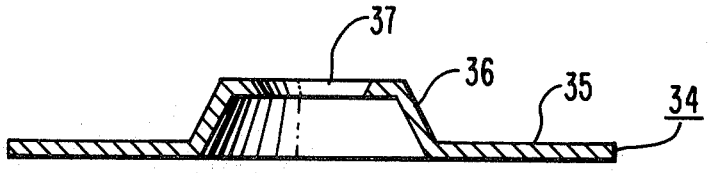
FIG. 7 is a sectional view taken along line 7—7 of FIG. 6.

The novel washer-like element 34, as shown in FIGS. 6 and 7, comprises a substantially flat base portion 35 and a frustoconically shaped, stud engaging portion 36. A stud engaging aperture 37 is provided in the frustoconically shaped portion 36. The generally off-set shape of the washer-like element 34 facilitates permanent welding of the washer 34 to the strap-like element 33, as will be described hereinafter. The washer 34 is preferably formed from either 301 or 302 stainless steel. The apex of the frustoconical portion 36 of the washer 34 extends about 1.65 mm above the base portion 35. The stud engaging aperture 37 of the washer 34 is tapered inwardly toward the base 35 to snugly grasp the stud 16.

In fabricating the assembly of panel 10 having the studs 16 located at a predetermined height above the faceplate 12, it is assumed that the Q-spacing between the mask member 28 and the faceplate 12 will provide register between the electron beams passing through the apertures in the mask electrode 24 and the red, green and blue phosphor screen components (not shown) which subsequently will be deposited on the interior surface of the faceplate 12.

The proximal end of each of the strap-like elements 33 is welded to the bimetallic clips 30 and the clip-strap 30, 33 is affixed to the frame 26. The sub-assembly 26, 30, 33 is placed in a conventional mounting fixture (not shown) where the mask member 28 is affixed to the frame 26. The studs in the mounting fixture are set at a predetermined height like the studs 16 in the faceplate panel 10 to provide an optimum Q-spacing when the mask assembly 26, 28, 30, 33 is placed in the faceplate panel 10.

With the mask assembly 26, 28, 30, 33 in position within the faceplate panel 10, the distal end of the strap-like element 33 adjacent to the stud 16, which is displaced from the midpoint of the lower long side 18 of the sidewall 14, is depressed toward the frame 26. A washer 34 is inserted over the stud 16, between the strap-like element 33 and the stud, so that the stud tip 22 is snugly received within the stud engaging aperture 37. In such an arrangement, the spring action of the strap-like element 33 urges the washer 34 against the frustoconical tip 22 of the stud 16 to keep the washer in place. The stud receiving apertures 31 of the other strap-like elements 34 are expanded outwardly to receive the tips 22 of the other studs 16.

The off-set provided in the washer 34 displaces the strap-like element 33 a greater distance away from the inside surface of the sidewall 14 and permits a larger first welding electrode (not shown) to be interposed between the sidewall 14 and the washer 34 than was possible in the prior art structure. A second welding electrode (not shown) is located between the strap-like element 33 and the frame 26 of the shadow mask 24. A pocket 38 is provided in the frame 26 to facilitate the welding operation. The larger welding electrodes make it possible to permanently weld the washer 34 to the strap-like element 33 while the mask assembly is disposed within the faceplate panel 10.

The Q-spacing may be set more accurately by the following alternative procedure. The mask assembly 26, 28, 30, 33 is positioned on top of a Q-set spacer device (not shown) within the faceplate panel 10, to accurately establish a desired mask-to-panel spacing. The panel may be oriented open-end-up, as shown in FIG. 2, so that the mask assembly 26, 28, 30, 33 is urged against the spacer and the spacer against the panel 10. The spacer device may comprise a T-shaped device, such as that shown in U.S. Pat. No. 3,334,259 to Shrader, referenced above.

In the alternative fabricating procedure, the distal end of each of the strap-like elements 33 is displaced toward the frame 26, and a washer 34 is inserted over each of the studs 16 between the strap-like elements 33 and the studs with the stud tips 22 snugly engaged within the stud engaging apertures 37. The strap-like elements 33 urge the washers 34 against the stud tips 22 to keep the washers in place.

At this point in the fabrication procedure, the washers 34 are free to move relative to the strap-like element 33; and the mask assembly 26, 28, 30, 33 and spacer device are free to be urged together and against the interior surface of the faceplate 12. Thus, in this condition, the precisely desired Q-spacing between the mask member 28 and the faceplate 12, and a precise alignment of the stud engaging aperture 37 of the washer 34 and the stud 16 can be established. The welding of the washers 34 to the strap-like elements 33 is identical to that described herein when only one washer 34 was utilized.

Figure 4:
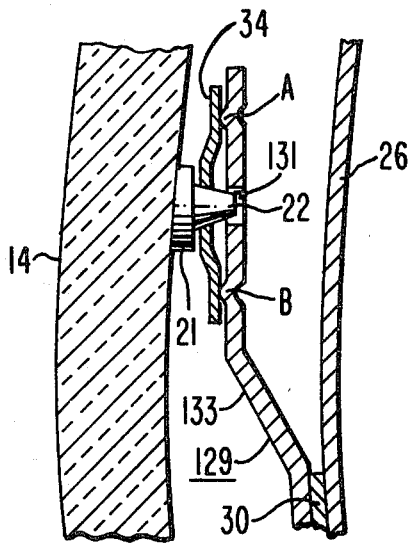
FIG. 4 is an enlarged sectional view of an alternative embodiment of the device of FIGS. 1 and 2 taken along 3—3 of FIG. 2.
Figure 5:
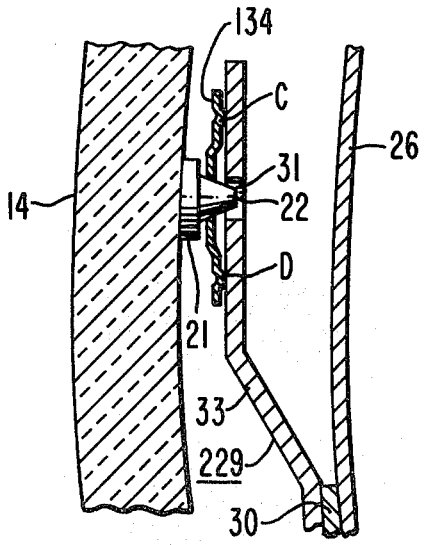
FIG. 5 is an enlarged sectional view of a second alternative embodiment of the device of FIGS. 1 and 2 taken along line 3—3 of FIG. 2.

FIG. 4 shows an alternative support spring 129 in which two projections A and B are formed in the distal end of a strap-like element 133 adjacent to the stud receiving aperture 131. The projections A and B are directed outwardly toward the washer-like element 34. The projections A and B localize the welding current to assure permanent attachment of the washer-like element 34 to the strap-like element 133. FIG. 5 shows another embodiment of a support spring 229 comprising a strap-like element 33 and a novel washer-like element 134 having two projections C and D formed in the base portion thereof. The projections C and D extend opposite to the direction of the frustoconically shaped stud engaging portion to facilitate securing the washer-like element 134 to the strap-like element 33. It should be clear to one skilled in the art that the alternative embodiments of FIGS. 4 and 5 are not limiting. For example, a single projection may be formed in either the washer 34 or in the strap-like element 33, or, one projection may be formed in the washer 34 and a complimentary projection may be formed in the strap-like element 33 to provide two points of contact between the respective members to facilitate welding. Also, more than two projections in either or both the strap-like element or the washer may be utilized if desired.

What is claimed is:

1. In a cathode ray tube of the type including a faceplate panel, a plurality of electrode support studs distributed about and attached to said panel, and a color selection electrode including a plurality of support springs, each of said support springs comprising a strap-like element having a proximal end secured to said electrode and a distal end spaced from said electrode, and a washer-like element located between said panel and said distal end of at least one of said strap-like elements, said washer-like element having an aperture therein for snugly receiving one of said studs, the improvement comprising said washer-like element having a substantially flat base portion and a frustoconically shaped portion extending above said base portion, said frustoconically shaped portion being provided with said aperture, said washer-like element having a generally off-set shape to facilitate attachment to said strap-like element.

2. The cathode ray tube as described in claim 1, wherein said strap-like element having said washer-like element attached thereto further includes at least one projection formed therein adjacent to said distal end, said projections being directed outwardly toward said washer-like element to facilitate the permanent securing thereof to said strap-like element.

3. The cathode ray tube as in claim 1, wherein said washer-like element includes at least one projection formed in the base thereof, said projections extending opposite to said frustoconically shaped stud engaging portion to facilitate the permanent securing of said washer-like element to said strap-like element.

* * * * *